United States Patent [19]

Sqrillo et al.

[11] 4,210,003

[45] Jul. 1, 1980

[54] KNITTING NEEDLE WITH REINFORCED HOOK

[75] Inventors: John J. Sqrillo, New Hartford; Richard W. Shepard, Torrington, both of Conn.

[73] Assignee: The Torrington Company, Torrington, Conn.

[21] Appl. No.: 913,341

[22] Filed: Jun. 7, 1978

[51] Int. Cl.[2] ..... D04B 35/04; D04B 35/06

[52] U.S. Cl. ..... 66/116; 66/120; 66/121

[58] Field of Search ..... 66/166, 123, 120, 121, 66/119, 117

[56] References Cited

U.S. PATENT DOCUMENTS

| | | | |
|---|---|---|---|
| 1,730,546 | 10/1929 | Van Dyke | 66/123 |
| 1,777,610 | 10/1930 | Gearhart | 66/117 |
| 2,044,324 | 6/1936 | Page | 66/121 |
| 2,252,302 | 8/1941 | Morith | 66/117 |
| 2,344,850 | 3/1944 | Cole | 66/121 |
| 2,522,335 | 9/1950 | Amidon | 66/120 X |
| 3,811,299 | 5/1974 | Peschl et al. | 66/120 |

FOREIGN PATENT DOCUMENTS

| | | | |
|---|---|---|---|
| 1635907 | 9/1970 | Fed. Rep. of Germany | 66/121 |

*Primary Examiner*—Werner H. Schroeder
*Assistant Examiner*—Andrew M. Falik
*Attorney, Agent, or Firm*—Frank S. Troidl

[57] ABSTRACT

A machine knitting needle with an improved hook structure is disclosed. The hook includes a shank portion extending from the tapered part of the needle blade, a curved portion, and a portion overlapping the shank. At least a major longitudinal part of the overlapping portion has cross-sectional areas greater than the cross-sectional areas of the remainder of the hook.

3 Claims, 9 Drawing Figures

KNITTING NEEDLE WITH REINFORCED HOOK

This invention relates to machine knitting needles. More particularly this invention is an improved machine knitting needle hook.

This new needle may be used in several ways, but the most common is for the making of pile and high pile fabrics. Such fabrics are used for clothing, clothing liners, footwear, upholstery, wall covering, paint rollers, carpeting, imitation fur, and a rapidly expanding further market.

The production of all of these products have one feature in common. The knitting needles which make the basic knitted fabric are required to thrust into the face of a rotating wire brush, variously called a card wire wheel or doffer wire wheel, so that their hooks may receive the silver or fiber which is carried to them by the card wires and which will become the pile part of the fabric. The needles, after having the sliver transferred into the hook area, have a yarn introduced to the same hook area, and they knit the yarn to form a fabric. This knitted yarn then acts to hold, or lock in, the looser silver fibers. The knitted yarn is referred to as a backing yarn and often because of the amount of sliver surrounding it, it is not visible from the front side of the fabric.

Many mills run the machines fast, hard, and long, demanding the utmost in performance of the needles and doffer wheels. Both the needles and the card wires rapidly wear out, but usually at different rates. As a result of the contact with the card wires, the hook section of the needle is quickly worn away, so quickly that needle life is measured in days. Sometimes the life is under ten days, usually under twenty. Almost always the life is under thirty days. Generally speaking, the life of a wheels but less than the life of two sets. The doffer or card wires wear out as a result of their contact with the needle hooks. When the card wiresor complete doffer wheels are to be changed, and it is determined that the partially worn needles will not last through the lifetime of a new set of doffer wheels, it is customary to change both the needles and the doffer wheels at the same time. Even though a set of needles is very expensive, it is still not as costly to the mill as is machine down-time. The operation of changing needles and doffer wheels is of considerable difficulty and requires partial disassembly of the machine, resulting in considerable financial loss due to maintenance labor cost and to the loss of production output on this high speed machine. Thus, a needle maker must make a needle which has a life which is at least as long as the life of one set of card wires, or else the wear-out and replacement condition will be reversed: The needles will wear out first, and the card wires will still have useful life when the doffer wheels must be replaced along with the needles because they will not last for the life cycle of the new needles.

Most currently made needles of this type have a life equal to more than one but less than two times the life of a set of card wires or doffer wheels. However, a needle life of more than one but less than two times the life of a set of doffer wheels has no advantage over a needle life the same as the life of one set of doffer wheels. Therefore, a latch knitting needle which will last two or more lifetimes of the doffer wheels provides a huge advantage in reduced replacement cost of needles and/or downtime of the machine. Needle costs are cut in half or better, and, as mentioned above, needles are expensive, as is machine downtime for replacement.

This new machine knitting needle with its improved hook will increase the needle life to a factor of two or more times the doffer wheel life. Briefly described, the new machine knitting needle has a tapered portion leading from the needle blade to the hook, and a new hook having a shank portion intergral with the tapered portion of the needle, a curved portion, and a portion overlapping the shank portion as it extends back toward the needle butt. At least a major longitudinal part of the overlapping portion has cross-sectional areas greater than the cross-sectional areas of the remainder of the hook, and especially of the shank portion.

The invention as well as its many advantages will be further understood by reference to the following detailed description and drawings in which.

In the various figures, like parts are referred to by like numbers.

Figure 1:
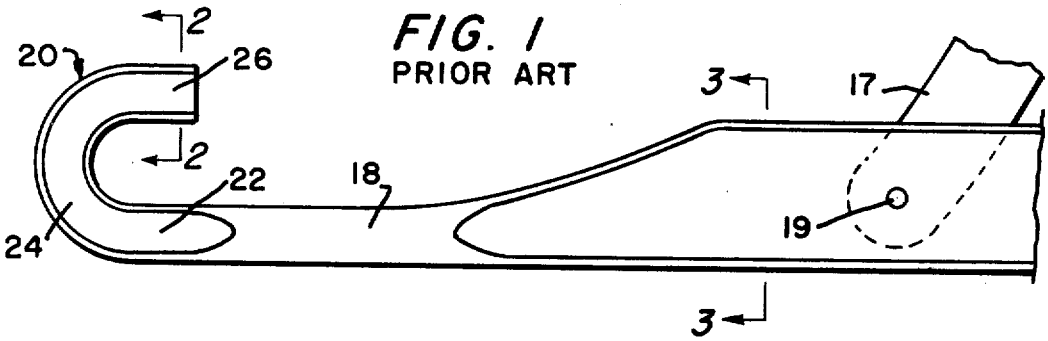
FIG. 1 PRIOR ART
FIG. 1 is a fragmentary elevational view of a prior art knitting machine pivoting-latch needle.
Figure 2:
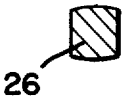
PRIOR ART FIG. 2
FIG. 2 is a view taken along lines 2—2 of FIG. 1 and in the direction of the arrows.
Figure 3:
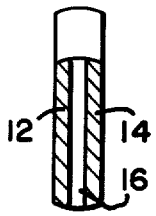
PRIOR ART FIG. 3
FIG. 3 is ₐ sectional view taken along lines 3—3 of FIG. 1 and in the direction of the arrows.

To understand the new development, it is necessary to examine the nature of the hook of a conventional machine knitting needle. One common version is called a pressed hook, shown on the pivoting-latch needle in FIG. 1 . The needle is pressed or flattened in the hook areas. It includes a pair of cheeks 12 and 14 (See FIG. 3) forming a slot 16 in the needle blade. The slot 16 is adapted to receive a pivotable latch 17 (partially shown in FIG. 1) which pivots about latch pivot 19 to alternately open the needle hook as shown in FIG. 1 and to close the hook by pivoting over so that the free end of the latch lies against the overlapping portion 26 of the hook.

The needle has a tapered portion 18 which interconnects the hook 20 and the blade. The hook has a shank portion 22 extending in the same general direction as the longitudinal axis of the needle, a curved portion 24, and an overlapping (not shown) portion 26 which extends back in the direction of the needle butt which overlaps the shank portion 22. For purposes of this description and the appended claims, the term "hook" is intended to mean the shank portion 22 which is overlapped by the overlapping portion 26, the curved portion 24, and the overlapping portion 26.

The cross-sectional areas of the entire hook may be equal, or the cross-sectional areas of the curved portion 24 may be slightly greater than the cross-sectional areas of the overlapping portion 26, and the cross-sectional areas of the shank portion 22 may be further slightly greater. The width of the overlapping portion 26 may be the same as the widths of the curved portion 24 and of the shank portion 22, or the width may increase from the overlapping portion 26 through curved portion 24 and shank portion 22.

In other types of prior art machine knitting needles the cross-section of the shank, curved portion, and overlapping portion of the hook are round and in general of the same cross-sectional areas. Other needles are round in those cross-sections but the cross-sectional areas increase as you progress from the free end of the hook back around the curved portion into the shank portion and on into the needle blade.

It is the nature of all known latch needles that the cross-sectional areas of the overlapping portions of the hook are equal to or smaller than the cross-sectional areas at the shank portion of the hook.

Our new needle is constructed to resist the severe wear caused by the card wires of the doffer wheels brushing against the needles in the manufacture of pile fabrics. The problem is solved by putting an extraordinary amount of metal in the overlapping area of the hook where the card wires or doffer wires generally cause most of the wear which results in the failure of these needles, thus incresing that hook wear life without making the rest of the needle unduly heavy or bulky. The sections of the hook which are beat against by the card wires may be harder then the rest of the needle only on particular areas of the surface or on the total surface area of those sections.

Figure 8:
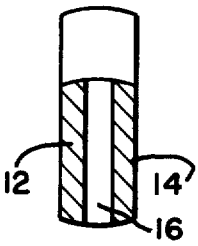
FIG. 8 is a sectional view taken along lines 8—8 of FIG. 4 and in the direction of the arrows.
Figure 4:
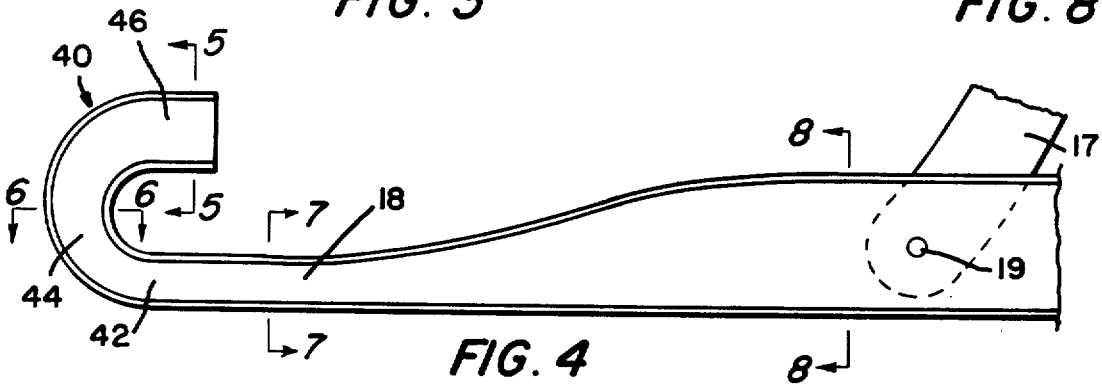
FIG. 4 is a fragmentary elevational view of a preferred embodiment of our new pivoting latch needle.

Referring to FIG. 4, the pivoting-latch version of our new machine knitting needle includes the usual pair of cheeks 12 and 14 (See FIG. 8) which form the slot 16 for receiving the pivotable latch. The tapered portion 18 interconnects the new hook structure, indicated generally by the numeral 40, and the cheeks. The hook 40 has a shank portion 42 extending in the same general direction as the longitudinal axis of the blade, a curved portion 44, and an overlapping portion 46 which extends back toward the butt and overlaps the shank portion 42.

Figure 7:
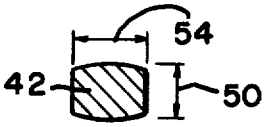
FIG. 7 is a sectional view taken along lines 7—7 of FIG. 4 and in the direction of the arrows.
Figure 5:
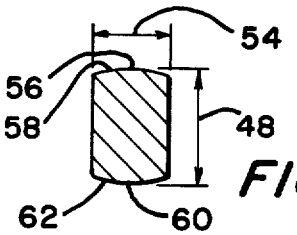
FIG. 5 is a sectional view taken along lines 5—5 of FIG. 4 and in the direction of the arrows.
Figure 6:
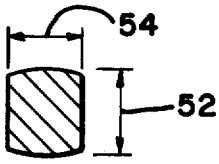
FIG. 6 is a sectional view taken along lines 6—6 of FIG. 4 and in the direction of the arrows.

At least a major longitudinal part of the overlapping portion 46 of the hook has cross-sectional areas greater than the cross-sectional areas of the remainder of the hook, and especially of the shank portion. In the embodiment shown in FIG. 4, the entire overlapping portion 46 has cross-sectional areas greater than the cross-sectional areas on the remainder of the hook. Thus the overlapping portion 46 has a greater height 48 (See FIG. 5) than the height 50 (See FIG. 7) of the shank portion 42. The height of the curved portion 44 increased from the shank portion 42 to the overlapping portion 46. The median height 52 of the curved portion 44 is indicated in FIG. 6. The overlapping area 46 is much larger in cross-sectional areas than the rest of the hook, thus providing a great deal of hook material to be worn through by the card wires, before hook failures without effecting the remaining needle structure. In the preferred embodiment the height 48 is at least 1.20 times the median height 50 of the shank portion 42 often it will be at least 1.50 times that height.

The width 54 may be constant throughout the entire hook, and may be as great as the width of the needle across the cheeks. The width of the overlapping portion 46 may even be greater than the width of curved portion 44 and/or shank portion 42, and may even be greater than the width across the cheeks of the needle. It can be understood particularly by reference to FIG. 5 that in the embodiment shown, a tangent to the outermost part 56 of outer surface 58 of the overlapping portion 46 would be substantially parallel to a tangent to the innermost part 60 of the inner surface 62, and each would be generally parallel to the surfaces of the shank portion 42. However, if desired, the outer and inner tangents need not be parallel, and the hook might be of the "closed in" type where the surfaces point inwardly at acute angles toward the tapered portion or of the "turned out" type where the surfaces of the overlapping portion point angularly outwardly away from the shank portion. Also, the overlapping portion 46 need not be uniform in cross-sectional area, nor need the cross-sectional dimensions from one cross-section be equal to the comparable dimensions of another cross-section. There may be tapers or multiple tapers, curves or compound curves. However, the cross-sectional areas of the major portion of the overlapping portion will be manufactured larger than cross-sectional area of the shank portion and possibly also of the curved portion of the hook. The extreme free end of the hook wire may be cut off flat-ended as shown, or its edges may be rounded or bevelled.

If desired, the cross-sections of the hook can be any other shape than that shown in FIGS. 4 through 7, including round. In addition, the cross-sections of any one hook do not all have to be the same shape. For example, the cross-sections of the overlapping portion could be substantially rectangular and the cross-sections of the shank and curved portion could be round. Each hook section could even be varying in shape and in cross-sections. As long as the volume of metal of the overlapping portion exceeds that volume normally in the overlapping portion because that portion has previously, in prior art, been no larger in cross-sectional area than the curved portion and the shank.

Figure 9:
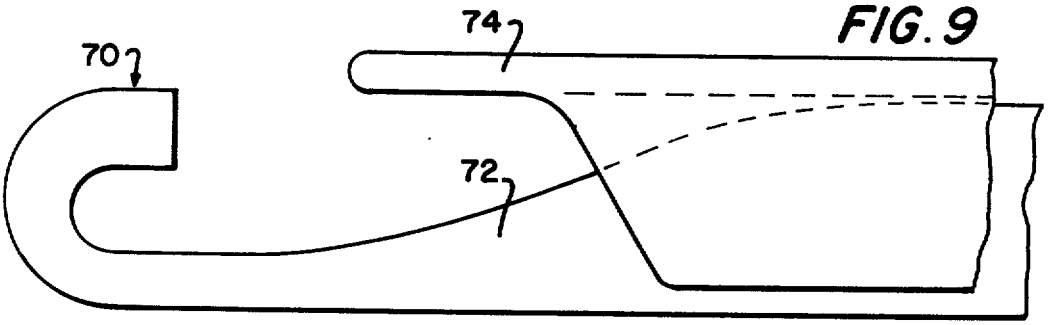
FIG. 9 is a fragmentary elevational view of a preferred embodiment of our new slide latch needle.

FIG. 9 illustrates our new hook on a slide-latch machine knitting needle, showing the increased volume of needle material built into the overlapping portion to be worn away by the card wires of the doffer wheel. In this case, the hook section 70 is comparable to the hook section 40 of the pivoting-latch needle of FIG. 4. However, instead of having a pivoting latch to close and open the hook, there is a sliding latch 74 which is attached to an element of the knitting machine in such fashion that it can be reciprocated independently from the remainder of the needle which includes the hook.

Knitting machines utilizing the slide-latch knitting needles generally can be operated at higher speeds than can machines with pivoting-latch needles. Thus the need for longer needle life is even greater for these faster-operating machines where needles and doffer wheels wear out faster and down-time for replacement comes around more often, and lost production is greater for each period of non-productivity.

We claim:

1. In a machine knitting needle with a tapered portion connecting the needle blade to the hook section, the improvement comprising: a hook integral with said tapered portion, said hook having a shank portion extending from the tapered portion of the needle, a curved portion having its entire outer surface curved and its entire inner surface curved and a portion overlapping the shank, said overlapping portion directly connected to the curved portion, at least a major longitudinal part of the overlapping portion having cross-sectional areas greater than the cross-sectional areas of the remainder of the hook, the outer surface and the inner surface of said major longitudinal part being substantially parallel, the width of the overlapping portion is at least as great as the width of the remainder of the hook, and the height of the overlapping portion is at least 1.20 times the median height of the shank portion of the hook.

2. In a pivotable latch needle with a tapered portion connecting the needle blade to the hook section, the improvement comprising: a hook integral with said tapered portion, said hook having a shank portion extending from the tapered portion of the needle, a curved portion having its entire outer surface curved and its entire inner surface curved and a portion overlapping the shank said overlapping portion directly connected to the curved portion, at least a major longitudinal part of the overlapping portion having cross-sectional areas greater than the cross-sectional areas of the remainder of the hook the outer surface and the inner surface of said major longitudinal part being substantially parallel, the width of the overlapping portion is at least as great as the width of the remainder of the hook, and the height of the overlapping portion is at least 1.20 times the median height of the shank portion of the hook.

3. In a sliding latch needle with a tapered portion connecting the needle blade to the hook section, the improvement comprising: a hook integral with said tapered portion, said hook having a shank portion extending from the tapered portion of the needle, a curved portion having its entire outer surface curved and its entire inner surface curved, and a portion overlapping the shank, said overlapping portion directly connected to the curved portion, at least a major longitudinal part of the overlapping portion having cross-sectional areas greater than the cross-sectional areas of the remainder of the hook the outer surface and the inner surface of said major longitudinal part being substantially parallel, the width of the overlapping portion is at least as great as the width of the remainder of the hook, and the height of the overlapping portion is at least 1.20 times the median height of the shank portion of the hook.

* * * * *